US005203723A

United States Patent [19]

Ritter

[11] Patent Number: 5,203,723

[45] Date of Patent: Apr. 20, 1993

[54] LOW COST PLASTIC HERMETIC ELECTRICAL CONNECTORS FOR HIGH PRESSURE APPLICATION

[75] Inventor: Thomas E. Ritter, Katy, Tex.

[73] Assignee: Halliburton Logging Services Inc., Houston, Tex.

[21] Appl. No.: 842,702

[22] Filed: Feb. 27, 1992

[51] Int. Cl.[5] ..... H01R 13/52

[52] U.S. Cl. ..... 439/589; 439/750

[58] Field of Search ..... 439/587, 589, 936, 271, 439/750, 283, 686, 695

[56] References Cited

U.S. PATENT DOCUMENTS

| | | | |
|---|---|---|---|
| 2,903,668 | 9/1959 | Cornell, Jr. | 439/598 |
| 3,290,639 | 12/1966 | Driemeyer | 439/589 |
| 4,305,636 | 12/1981 | Jackson et al. | 439/589 |
| 4,976,634 | 12/1990 | Green et al. | 439/936 |

FOREIGN PATENT DOCUMENTS

| | | | |
|---|---|---|---|
| 3843852 | 10/1989 | Fed. Rep. of Germany | 439/589 |
| 803059 | 2/1981 | U.S.S.R. | 439/283 |

*Primary Examiner*—Gary F. Paumen

*Attorney, Agent, or Firm*—William J. Beard

[57] ABSTRACT

A high pressure high temperature hermetically sealed electrical connector pin construction is set forth for use in down hole logging tools. On exposure to 28,000 psi at elevated temperatures, the present apparatus is able to handle such pressure and temperature cycling. Moreover, an elongate pin having two ends for forming electrical connections is used, the pin having a shoulder, a central threaded portion on one side of the shoulder and is formed of conductive metal that joins with a plastic body which is bonded thereto either by in situ molding to the pin or by an epoxy resin and the pin further threads to the body. In a multipin construction, the body is a circular insert for a surrounding cylindrical steel housing.

12 Claims, 1 Drawing Sheet

FIG. 1
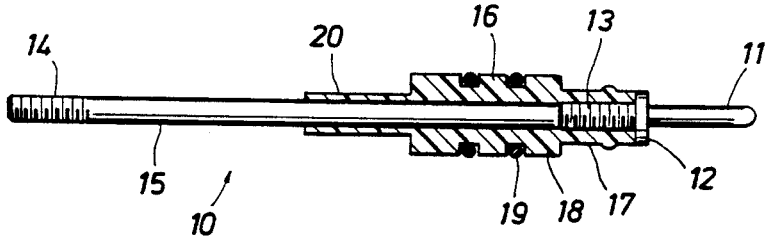
FIG. 2
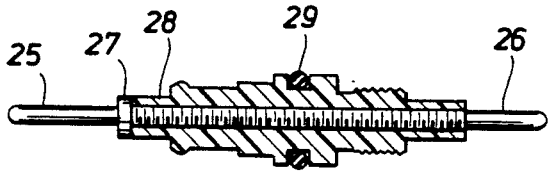
FIG. 3
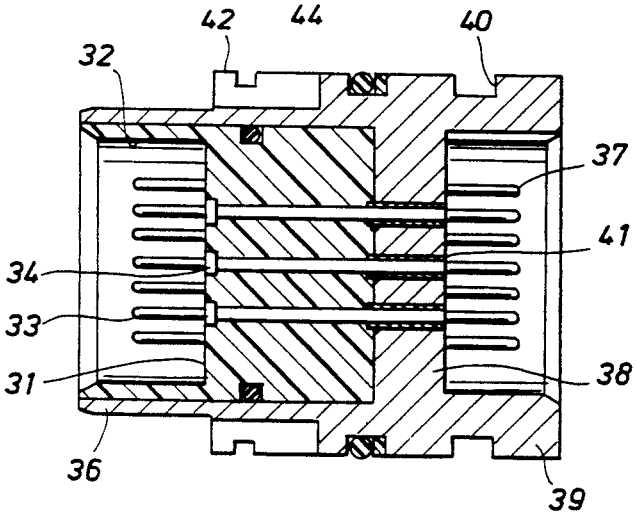
FIG. 4
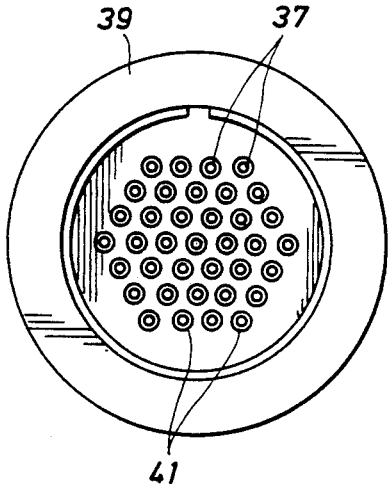
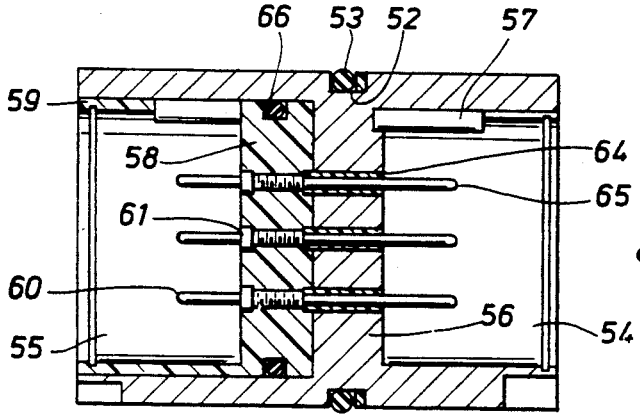
FIG. 5
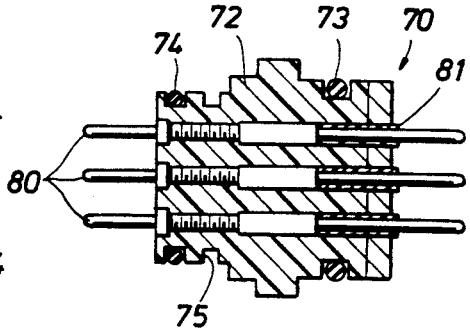
FIG. 6

LOW COST PLASTIC HERMETIC ELECTRICAL CONNECTORS FOR HIGH PRESSURE APPLICATION

BACKGROUND OF THE DISCLOSURE

The present disclosure is directed to a hermetically sealed connector for use in oil well logging tools, and particularly those which are used in extremely high pressures and temperatures. This device typically finds application making connections within a sonde of a down hole oil well logging tool which is lowered in a well to depths were ambient temperatures are 500° F. or greater, and the ambient pressure can be as high as 25,000 or perhaps 28,000 psi.

The present invention relates to electrical hermetic connectors for use in subsurface, high temperature and pressure applications. For example, tools used in logging oil wells consist of various electronic instruments contained within pressure housings and maintained at atmospheric pressure. The electronics inside the pressure housing requires a hermetic type electrical connector which interconnects with electrical conductors in a wireline to maintain communications with electronic instruments at the surface. The hermetic connector can be either a single-pin or multi-pin type depending upon the specific application. Furthermore, the connectors must easily connect and disconnect and function as electrical conductors in extreme hostile liquid environments such as brine, oil base drilling mud and fluids that may contain hydrogen sulfide, carbon dioxide, methane, and other elements at pressures to 28,000 psi and temperatures to 510° F.

The connector must be constructed in such a way as to assemble into a bulkhead and provide a hermetic seal capable of withstanding high differential pressures to 28,000 psi at 510° F. while at the same time carry high voltages. Typically, when the connector is exposed to the borehole fluids, a rubber boot seal is used that fits over the male end of the connector providing a total moisture-free seal for the conductive pin (or pins). When the connector is used inside the tool, it may be sealing against hydraulic oil used to hydrostatic pressure balance the mechanical section of the tool. In this case, the connector must be capable of withstanding high differential pressure without the rubber boot seal.

DESCRIPTION OF THE PRIOR ART

A typical single pin type connector to which the invention pertains include a conductive pin in the center covered by an insulating material which in turn is encased in a metal body. Two types of construction are generally used. In one type, the center pin is insulated and bonded in place with the outer metal body by a fused glass insert located at some distance from each end of the metal body. A ceramic insulator is then inserted in the ends and bonded in place with an epoxy adhesive. The fused glass functions both as an insulator and as a hermetic seal. In another type of construction, the center pin is insulated from the outer metal body by a one piece ceramic insulator that is bonded to the pin and metal body with a metallic brazing material. In this case, the ceramic material functions as the insulator and the braze functions as the hermetic seal. This device generally represents the prior art devices now in use.

A typical multi-pin type connector containing any number of pins is generally constructed of a metal body made of Inconel with Inconel pins that are bonded in place by fused glass. The fused glass functions both as an insulator and as a hermetic seal.

Some disadvantages of these types of connectors are (1) high cost, (2) the pin and body material must have a thermal coefficient of expansion closely matching the fused glass which is generally a high-cost difficult to machine material such as Inconel or Kovar, (3) an inherent characteristic that results in a degradation of the insulation resistance after exposure to a number of heat and pressure cycles which eventually renders the connector unusable, (4) an elaborate manufacturing technique is required to assemble the parts of the connector preventing most end users from making their own connectors, and (5) multi-pin connectors are configured with pin patterns which result in an uneven distribution of stress at high temperatures. Due to the geometric nature of multiple pin patterns, individual pins are subjected to inherent asymmetrical directional stresses due to expansion of materials when exposed to high temperatures and pressures. Furthermore, the steel body and pins have a different thermal coefficient of expansion from the fused glass. Since these are all rigid materials, they are unable to adjust for thermal distortion. The unbalanced nature of the stresses on individual pins may damage or significantly weaken the fused glass seals. This in turn could explain why multi-pin connectors with fused glass seals do not always hold up under test pressures of 28,000 psi at 510° F. when exposed to a number of cycles.

Single pin hermetic connectors made of plastic similar to the present invention have been known to exist since 1985. Halliburton Logging Services, Inc., a Halliburton Co., made electrical connectors from Fiberite FM-4005F resinphenolic by both transfer mold and injection mold techniques. These connectors were limited to a maximum of 20,000 psi at 400° F. More recent single pin plastic connectors made by Teledyne Mecca are similar to the present invention with the exception that the pin is not threaded but is press fit into the plastic body. This type construction is limited by the strength of the epoxy bond which results in deformation of the plastic body at high pressure and temperature. Furthermore, the interference fit of the pin in the body could damage the plastic body during assembly resulting in a high scran rate which increases the cost.

Multi-pin connectors made of plastic are not known to exist for high pressure and temperature applications. The current invention of a multiple-pin plastic connector claimed in this disclosure appears to be unique in that it can withstand pressure to 28,000 psi at 510° F. for any number of cycles. Unlike the steel/fused-glass construction, the plastic is not a rigid material. The new plastic construction has a forgiving characteristic such that at high temperatures it will relax and adjust to thermal expansion without causing the multi-pin connector to fail. Plastic single-pin connectors exhibit this same forgiving characteristic. Even though the stresses are more uniform for single pin connectors with respect to the geometric pin configuration, single-pin connectors of rigid steel/fused-glass construction are more sensitive to temperature distribution anomalies and small manufacturing defects in the pin, fused glass, and steel body than single-pin connectors of plastic construction.

SUMMARY OF THE INVENTION

It is therefore an object of the present invention to overcome the shortcomings and disadvantages of currently available hermetic connectors and replace them with a low cost, plastic type connector capable of withstanding pressures of 28,000 psi at 510° F. for any number of cycles. Another object of the present invention includes a simple method of construction that can be manufactured by current machine shop practices without any type of special technique or technology which is now used in manufacturing hermetic connectors.

Furthermore, the plastic hermetic connectors of the present invention do not exhibit any degradation of the insulation resistance after exposure to a number of heat and pressure cycles which will contribute to improvements in reliability and long life. The improvement in insulation resistance is due to two factors: (1) in the plastic connector, the complete body is an insulator which makes the path from pin-to-ground a long distance and (2) Celazole plastic has excellent electrical properties with a Dielectric Strength of 550 v/mil and volume resistivity of $8\times10^{14}$ ohm-cm.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a single pin connector capable of hermetic sealing in a well logging tool wherein the central pin and surrounded body are constructed in a fashion to be described to operate at extremely high pressures and temperatures;

FIG. 2 is an alternate view to the structure of FIG. 1 showing a central pin and surrounding body construction for a single pin connector wherein the pin and surrounding body provide hermetic sealing in use;

FIG. 3 is a lengthwise sectional view through a mating plug and socket for sealing at a bulk head to provide multiple connectors through the bulk head;

FIG. 4 is an end view of the plug and socket shown in FIG. 3 showing a multiplicity of pins, in this case, 37 in number to provide a multiconductor connection through the bulk head;

FIG. 5 shows an alternate embodiment to the construction of FIG. 3 with a different arrangement of cylindrical shell or housing components; and FIG. 6 shows an alternate form of construction of an insert which can be positioned in a drill hole opening in a bulk head.

DETAILED DESCRIPTION OF THE PREFERRED EMBODIMENTS

Attention is first directed to FIG. 1 of the drawings where the numeral 10 identifies a single conductor connector. It will be described hereinafter as a single pin hermetic connector. It has two primary components. The first is the metal conductor which extend through it which will be described in particular. Briefly, the metal conductor in the center includes a male pin 11 extending at one end from a shoulder 12. The shoulder defines the limits of the outer body as will be described, and is formed around the pin 11. The metal member is formed with a set of threads at 13 which extend partly along the length of the body. The threads are located from the shoulder 12 along the length of the body and can extend if desired to the opposite end as illustrated at 14. The full length of the body is an elongate cylindrical member from the shoulder 12. The full length body 15 is constructed with sufficient length so that it is exposed for connection by threads or otherwise with a conductor which connects to it.

From the shoulder, there is a plastic body 16 which has a relatively thin wall portion 17 immediately adjacent to the shoulder 12, and enlarged or thickened central body portion 18, and appropriate grooves cut in the exterior of the thicker portion 18. The grooves receive suitable seal rings 19 in them. In the preferred embodiment, two or three grooves are typically provided and they are incorporated to support seal rings. The diameter of the elastomeric body is sufficient that it plugs into a bulk head opening. By means of suitable fittings, the connector is anchored at the bulk head with means compressing the seal rings 19 to prevent leakage along the exterior.

The body terminates at an elongate sleeve portion 20 which extends from the larger diameter body portion so that the device can be anchored at a bulk head and yet have insulative material extending on both sides of the bulk head. The thickness of the bulk head is typically equal to or less than the total length of the thickened portion 18 shown in FIG. 1 of the drawings. The fittings necessary to anchor the device in a bulk head have been omitted for sake of clarity.

Going now to more specific details of construction, it is desirable that the pin be formed of conductive material. It can be an alloy or it can be a highly conductive material such as aluminum or copper and it can be plated or clad in an alloy to enhance connectability as well as wear. Moreover, the pin is constructed with a number of threads as mentioned at the regions 13 and 14 along the length of the pin and indeed, the threads can extend the full length of the pin from the shoulder 12. Generally, the threads are especially helpful for making connections on the exposed area as mentioned, but they also serve a fabrication purpose. Preferably, the threads extend the full length of the stem, or at least a substantial portion beneath the plastic body which is placed on the stem. One preferred form of plastic materials a polybenzimidazole polymer family, and a convenient and available form is provided under the trademark Celazole of the Hoechst Celanese firm. Among other things, it has a very high dielectric strength of about 550 v/mil thickness and a volume resistivity just below about $10^{15}$ ohm-cm. Moreover, this is formed on the stem by either of two manufacturing processes. For instance, the plastic member shown in FIG. 1 can be made with an internally threaded hole formed in it and the metal pin can be threaded by rotation or pressing the metal pin through the passage. If this method of fabrication is used, it is preferable to incorporate threads on at least a portion of the metal member as exemplified in FIG. 1 where they extend in the region 13 adjacent to the shoulder 12 and to additionally place a suitable adhesive such as a slow drying epoxy resin on that region of the metal member so that it adheres to the surrounding plastic body. An alternate method of fabrication is to position the metal pin in the cavity of an injection mold mechanism providing this shape of construction and mold the plastic member about the metal member. In either case, it is desirable that the plastic member be bonded to the metal member to prevent leakage along the length. Moreover, this type construction can be accomplished with a view of anchoring the device at a suitable bulk head without regard to the method of manufacturing once the curing cycle has been accomplished.

FIG. 2 of the drawings shows a similar embodiment where the full length of the metal member 25 is threaded in the region 26 for substantially the full length of the metal member behind the shoulder 27. In this particular embodiment, the encircling plastic member 28 is constructed with a single groove with an O-ring 29 positioned in it for sealing purposes. It extends from the back of the shoulder 27 and is constructed to the illustrated profile so that it can support appropriate fastening components when attached to a bulk head. More particularly, the embodiment shown in FIG. 2, like the version 10 shown in FIG. 1, is fabricated in the same fashion using either of two manufacturing processes. As mentioned, a central passage can be formed in the plastic body and the metal pin can be threaded into the passage, and is held in place by an epoxy resin adhesive. Alternately, the metal member can be positioned in the mold of an injection molding machine which casts the plastic body in place around the pin. In both instances, this type construction is quite adequate to assure that no leakage occurs along the length of the metal pin. Moreover, the method of joining or sealing of the plastic body to the metal pin assures that no leakage occurs and that the two components which make up the construction hold together through numerous heating and cooling cycles. As was mentioned earlier, holding a hermetic seal is in part dependent on the ability of the elastomeric material to yield without breaking its bond to the metal member and without accumulating excessive stress as a result of temperature differential in the expansion and contraction with heat cycling.

Attention is now directed to FIG. 3 of the drawings where the numeral 30 identifies an alternate embodiment. This is a multipinned embodiment. The number of pins can very, and as shown in FIG. 4 of the drawings, this embodiment is constructed with 37 pins. Quite obviously, that number can be increased or decreased as required. In any event, the embodiment shown in FIGS. 3 and 4 considered jointly is a typical construction of 37 pins with a pin spacing of about 0.138 inches between pins and a body diameter of 1.75 inches. Proceeding from the interior, a cylindrical cast body of the above mentioned polybenzimidazole polymeric material is formed and is identified by the numeral 31. It has a skirt 32 which encircles one end of it. It is preferably formed with a number of holes in it, the holes being arranged in a pattern and of a diameter to receive the pins as will be described. The multiple pins are formed of conductive metal members as illustrated and have the specific instruction of an elongate conductive metal members 33. They each include a shoulder 34 which serves to limit entry into the plastic body 31. The holes that are formed in the body 31 are preferably threaded at formation either during molding or by subsequent drilling with a tool capable of forming a thread i.e. a die and tap set. The holes are provided in the requisite pattern. They are made relatively snug in compared with the metal pins to be inserted into them. The metal pins are preferably threaded, meaning that the pins screw into the plastic body 31. The pins are bonded in place and hermetically sealed with epoxy adhesive applied to the thread on the pins. For sake of clarity, the threads on the pins have been omitted, but they are preferably included at the portions of the pins which are surrounded by the plastic body 31.

The pins extend fully through the plastic body and are exposed on the opposite side of the body. The plastic plug 31 (having the form of a cylinder) is formed within a circular steel housing 36 which extends to the back end of the structure and which extends forwardly to enclose the full length of all the pins, and is actually longer than the pins. This defines an internal chamber region on the left and a similar chamber region on the right. Because this is a connector which mates with and connects with a bulk head, there is a set of exposed pin tips 37 on the opposite side of a transverse bulk head 38. The bulk head 38 is an inwardly directed transverse wall across the housing 36. The housing 36 has a thickened wall 39 and it is ringed with a pair of seal receiving grooves 40. The grooves support seal rings which aid in anchoring the cylindrical housing 36 in place.

The transverse bulk head 38 on the interior of the cylindrical housing is provided with suitable openings so that the pins are able to extend through the openings. The pins are electrically insulated by insulative material 41 where the pins extend through the bulk head 38. This forms a resilient mounting mechanism which protects the individual pins 33 from shorting laterally to the bulk head 38. More specifically, each of the pins (whether one or many) extends from the plastic body 31 and does not contact metal but rather contacts the surrounding plastic insulators positioned around the pins. The pins can be positioned within the transverse internally directed bulk head 38, and plastic material forming a second plug can be cast to extend the bulk head. The first plastic plug is that illustrated at 31 which is formed of the material previously specified. The plastic body must be of sufficient strength to hold the pressure, maintain solid mounting, and to otherwise provide mechanical and structural integrity notwithstanding thermal cycling in use while it heats and cools. The plastic material at the transverse bulk head is generally identified at 41 and can be as mentioned cast in place, and simply provides lateral electrical insulation without necessarily providing structural strength. This material can be a relatively soft plastic material if desired.

The housing 36 is constructed with suitable connective tabs 42 on the exterior which enable fastening or locking in place. The plastic plug 31 on the interior is held in place by the seal ring 44 which is located between the metal shell and the elastomeric plug of cylindrical construction. This prevents leakage along the sidewall of the metal housing which holds the structure together.

Attention is now directed to FIG. 5 of the drawings where the numeral 50 identifies an alternate embodiment. Here, the outer cylindrical housing 51 has an external groove 52 which receives a seal ring 53. There is a cavity or chamber 54 at one end and a similar cavity or chamber at the opposite end identified at 55. A transverse bulk head 56 formed of metal an interal with the construction is also shown. In this particular embodiment, an alignment pin 57 provides a nonsymetrical alignment mechanism for easy connection. Moreover, a plastic plug 58 is inserted on the opposite side of the transverse bulkhead and is provided with a protruding skirt 59 which is interrupted by an alignment pin on the left in the same fashion as the pin 57 on the right. The plug 58 of plastic material functions in the same fashion as the plug 31 previously mentioned. The difference in this construction primary relates to the size or length of the various pins. Here, a single pin 60 is illustrated as incorporating an end located shoulder 61 defining limits of the pin entry into the plastic plug. The pins extend through appropriately located holes in the transverse metal bulk head 56. Those holes are filled with electrical insulating material indicated by the numeral 64. This enables the exposed plug tips 65 to be electrically isolated from all metal contact.

This particular embodiment uses a somewhat shorter pin and a therefore thinner plastic plug 58. In like fashion it is held in position by the surrounding seal ring 66. However, the resilient member is more shallow, not or not as deep and is held in place by virtue of its support within the steel housing. The plastic plug 58 is preferably sealed against leakage from the left to the right as viewed in FIG. 5 by preventing leakage around the exterior at the seal ring 66, and is also protected by or held in place by a snug fit that it develops with the surrounding cylindrical case or housing. If need be, it can be bonded to the housing by casting in situ or by placing a suitable epoxy resin between the metal cylindrical shell and the plastic plug. As before the pins extend through the transverse bulk head 56 and are prevented from touching metal to metal by an insulative material which is placed in the holes formed in the transverse bulk head 56 which are larger in diameter than the pins. As before, the pins are attached to the plastic plug 58 either by bonding with an adhesive, casting in place, and also by threading the pins so that the threads grip the resilient material.

FIG. 6 of the drawings shows another embodiment which is identified by the numeral 70. This embodiment does not include an encircling housing. It is constructed so that it can be inserted into an opening formed in a bulk head. It incorporates an end located steel plate 71 of circular configuration. The steel plate 71 abuts one end of a plastic body 72, and the body 72 is formed of the same material as mentioned. The body 72 has a forward ring formed in it to receive a seal ring at 73, and a rear groove with seal ring at 74. The rings 73 and 74 provide sealing to the surrounding structure. An additional groove for a seal ring is also incorporated at 75. The plastic body is preferably cast is a mold so that it bonds to the plate 71, or is attached to it with an epoxy resin. In addition to that the pins 80 are positioned in the plastic body 72 in the same fashion as before. These pins incorporate the shoulder or enlargement shown at the left hand side of FIG. 6, and they are threaded, at least for a portion of their length. Moreover the pins are attached to the body in the same fashion which can be casting with bonding to the resilient body so that threads on the exterior of the pins form a bonded connection to the plastic body formed around the pins. The alternate approach is to thread the pins as mentioned above into holes in the body with an epoxy resin adhesive placed in the holes. This permits curing of the epoxy resin to make a solid bond.

There are sleeves of insulative material filling out the enlarged holes, the sleeves being identified at 81 and they extend around the pins to the point where the threads end. They pass through slightly larger holes formed in the steel plate 71 to assure that there is no metal to metal contact.

As a generalization, the device of the present disclosure is able to handle temperature and pressure cycling repetitively. The coefficient of expansion with increase in temperature is particularly an important factor which enables stresses to be formed in the plastic material without destruction of the structure. Moreover, the pins maintain a quality connection with the surrounding resilient material. This is accomplished even with both of the connections previously mentioned namely casting in situ for bonding or attaching by an epoxy adhesive. In all instances, it is preferable that the pins include threads so that they screw into the body. A snug, even tight fit with epoxy adhesive is necessary to assure that leakage under pressure drive of 28,000 psi does not occur along the respective pins. This enables the appropriate hermetic seal to be accomplished so that the device can be cycled time and again during its use in well borehole applications where tools are lowered to great depths.

In the installation of this connector, the embodiments of FIGS. 1 and 2 are normally inserted in a housing which can also be a bulkhead hole with cooperative threaded fasteners such as lock washers and nuts. In the use of a single conductor as shown in FIGS. 1 or 2, the conductors connect at the ends of the pin to mechanically complete the circuit. The views of multiple pin connectors show cylindrical housing which are usually made of steel. However, the steel cylindrical sheet can be omitted by forming a bulkhead with a hole profiled to function as the housing. The housing supports the body in the housing; however, this can also be done by shaping the bulkhead opening in the same fashion. Indeed, an O-ring and supportive shoulder can also form an acceptable seal.

Alternate plastics acceptable to this connector construction include:

(1) PEEK which is polyetheretherketone (glass filled), a product of ICI American Inc., Alpha Precision Plastics, Inc., The Polymer Corp. and others;

(2) Torlon which is a polyamid-imid sold under the trademark of Amoco Chemicals Corp.;

(3) PEK which is polyetherketone, a product of Green, Tweed & Co., Inc.;

(4) Vespel which is a polyimide sold under the trademark of E.I. DuPont DeNemours & Co., Inc.; and (5) Envex which is a polyimide sold under the trademark of Rogers Corp.

While the foregoing is directed to the preferred embodiments, the scope of the present disclosure is set forth by the claims which follow.

In the claims:

I claim:

1. A high pressure hermetically sealed connector comprising:

(a) plural elongate conductive pins wherein each of said pins has two ends and a central elongate portion wherein the central portion includes an irregular surface means;

(b) a polymeric body surrounding the central elongate portion of said pins to thereby position the respective ends of said pins exposed for connections in a circuit, and wherein said body secures said pins parallel to each other and said pin ends terminate as two sets of exposed pin ends for connection on opposing sides of said body;

(c) wherein said body and said pins are bonded at the irregular surface means to prevent leakage along said pins;

(d) wherein said body has openings therethrough to encircle and fit about and in a surrounding relationship to said pins and said body has an external sealing surface therearound;

(e) a surrounding housing which contacts against and seals with the external sealing surface of said body wherein said housing is formed of metal and supports a metal wall transverse thereacross and abutting said polymeric body, and said wall enables said body to be registered there against and held in a sealing relationship;

(f) plural aligned holes in said wall to align each of said pins to enable said pins to extend through said wall so that said pins position one set of ends on one side of said wall and another set of pin ends on the opposite side of said wall;

a separate insulative sleeve having sufficient length positioned around each of said pins to enable said pins to be electrically insulated from said wall to avoid electrical grounding thereto;

(h) an O-ring registration shoulder cooperative with an O-ring to permit interconnection in a hermetically sealing fashion between said body and said metal housing; and (i) wherein said pins provide individual electrically insulated connections through said hermetically sealed housing.

2. The high pressure hermetically sealed connector of claim 1 wherein said irregular surface means comprises threads formed on said pin and a bonding material is placed at said threads for bonding to said polymeric body, and further wherein said transverse wall is formed of metal and comprises a transverse face across said housing and is supportive of said body on exposure to a high pressure differential across said housing.

3. The high pressure hermetically sealed connector of claim 2 further including means for fixing the rotational position of said body within said housing to assure alignment with said housing and thereby align the pins supported by said body with respect to said housing.

4. The connector of claim 1 further including means for fixing the rotational position of said body within said housing to assure alignment with said housing and thereby align the pins supported by said body with respect to said housing.

5. A high pressure hermetically sealed connector comprising:

(a) an elongate conductive pin having two ends and a central elongate portion thereof which central portion includes an irregular surface means;

(b) a polymeric body surrounding said central elongate portion of said pin thereby leaving the two ends of said pin exposed for connection in a circuit;

(c) wherein said body and said irregular surface means of said central elongate portion of said pin are bonded together to prevent leakage along said pin;

(d) wherein said body snugly fits to said pin and includes an external sealing surface;

(e) a surrounding metal housing fixedly about said body at said external sealing surface;

(f) a metal wall having a transverse face extending fully across said housing, said wall enabling said body to be registered and held in a sealing relationship within said housing and against said wall;

(g) an aligned hole in said wall to align said pin to enable said pin to extend through said wall;

(h) a separate insulative sleeve about said pin having sufficient length to enable said pin to be electrically insulated from said wall; and (i) wherein the exposed ends of said pin extend through said wall and are on opposite sides of said walls.

6. A connector as recited in claim 5 wherein said pin and said body are bonded together by a bonding material between said pin and said body to form a leak proof seal preventing fluid leakage along said pin.

7. A connector as recited in claim 5 further comprising an O-ring registration shoulder on said body to receive and support an O-ring to enable a seal to be formed on positioning said body in said housing.

8. A connector as recited in claim 5 wherein said pin and said body have cooperating threads so that said pin and said body are joined together.

9. A connector as recited in claim 8 wherein a bonding material is placed between said cooperating threads to form a leak proof seal preventing fluid leakage along said pin.

10. The connector as recited in claim 8 wherein multiple identical pins are bonded to said body, and wherein each of said pins are parallel to and include a protruding shoulder sized and located to register said pin in said polymeric body.

11. A connector as recited in claim 8 wherein multiple identical pins are bonded to said body, and wherein each of said pins are parallel to and support a respective said insulative sleeve therearound, said sleeves having sufficient length to enable the exposed portion of said pins to be electrically insulated from aligned holes in said wall.

12. A connector as recited in claim 11 wherein said pins are equal in length.

* * * * *